United States Patent [19]

Oinonen

[11] Patent Number: 4,669,646

[45] Date of Patent: Jun. 2, 1987

[54] ARRANGEMENT FOR WEB SPREADING

[75] Inventor: Hannu Oinonen, Jarvenpaa, Finland

[73] Assignee: Oy Wartsila Ab, Helsinki, Finland

[21] Appl. No.: 633,119

[22] Filed: Jul. 20, 1984

[30] Foreign Application Priority Data

Jul. 22, 1983 [FI] Finland ..... 832680

[51] Int. Cl.[4] ..... B65H 23/035; B65H 23/038; B65H 27/00

[52] U.S. Cl. ..... 226/194; 226/198; 242/56.4; 242/76

[58] Field of Search ..... 226/196, 197, 198, 199, 226/194; 242/56.4, 76; 29/116 AD

[56] References Cited

U.S. PATENT DOCUMENTS

| | | | |
|---|---|---|---|
| 674,919 | 5/1901 | Jefferis | 242/56.4 |
| 1,638,560 | 8/1927 | Beveridge | 226/199 X |
| 2,560,039 | 7/1951 | Harlow, Jr. | 226/194 X |
| 3,106,365 | 10/1963 | Karr | 226/199 X |
| 3,266,743 | 8/1966 | Moser et al. | 242/56.4 |
| 3,305,153 | 2/1967 | Keding et al. | 226/199 X |
| 3,463,377 | 8/1969 | Lucas | 226/197 |
| 3,786,975 | 1/1974 | Heymanns | 226/194 |
| 3,848,304 | 11/1974 | Lucas | 29/116 AD |
| 4,176,775 | 12/1979 | Brendemuehl | 226/197 X |
| 4,410,122 | 10/1983 | Frye et al. | 226/199 |

*Primary Examiner*—Harvey C. Hornsby
*Assistant Examiner*—Scott J. Haugland
*Attorney, Agent, or Firm*—Dellett, Smith-Hill and Bedell

[57] ABSTRACT

An arrangement for a transverse spreading of a travelling web, in particular a paper web or the like, which web is in contact with at least one spreading appliance adjustable by its curvature. Said curvature is pretrimmable in the web travel direction and said appliance comprises a body member, and supported hereat, a spreading member mainly corresponding to the entire transverse extension of the web. The spreading member comprises a support member adapted to be bent towards the web, and at least two mainly rigid, web contacting rolls, which are located one after another in the web transverse direction and are journalled at said support member. Said arrangement comprises means for the provision of a movable support of said spreading member and a deflectable adaption of said support member for an adjustment of a second curvature of the spreading appliance, in a direction towards the web and independently from the pretrimmed curvature, said adjustment being carried out by adjustment members so, that a separation between the body member and the support member is altered at a plurality of different positions in the transverse direction of the web.

18 Claims, 4 Drawing Figures

ARRANGEMENT FOR WEB SPREADING

FIELD OF THE INVENTION

The invention relates to an arrangement for a transverse spreading of a travelling web, in particular a paper web or the like, said web being in contact with at least one spreading appliance adjustable by its curvature, said curvature being pretrimmable in the web travel direction, and said appliance comprising a body member supporting a spreading member mainly corresponding to the entire web transverse extension, said spreading member comprising a support member and at least two mainly rigid rolls located one after another and supported at said support member.

PRIOR ART

By a transverse directed web spreading one strives to eliminate eventual folds in the web, or through sideways spreading to separate different strips of a web, slitted by a slitter, far enough from each other for further processing. The aim is to prevent the web from sliding along the spreading member, but to carry out an eventual web sideways shift by sideways folding the web using a first spreading member and by returning the web in its travel direction using a second member. Separated web strips are likewise guided in a main travel direction. It is usual to guide a moving web into contact with a spreading member bent towards one direction. The spreading member can be a bar or a beam, as shown in Patent Specifications U.S. Pat. Nos. 3,106,365 and 3,463,377. Hereby the web contacting surface must be shaped in advance to correspond with the chosen radius of curvature. Rotating roll mantles journalled at an arched shaft have also been used. The mantle can be continuous and elastic or assembled from the mantle elements, whereby rigid elements are mutually connected with elastic connection members. The mantle elements can also be separate, as shown in European Patent Application No. 66527 and U.S. Pat. No. 3,848,304. The contact path of the web and the mantle usually corresponds to 10° . . . 90° of the mantle periphery angle. The problem in these mantle spreaders is, however, that the travel direction of the web and the rotation vector corresponding to the mantle rotation are askew relative to each other, at least at some mantle location. Hereby the web is influenced by a force component, which strives to glide or display the web on the roll mantle roughly parallel to the axial direction of the roll.

One has tried to eliminate this glide problem by redeflecting the spreading roll in the web travel direction so that the roll curvature is altered. In addition to the straightening of the folds, the web is hereby affected at its central portion or edge portions by a longitudinal stretching effect. This effect can not be eliminated in the known art without an alteration of the spreading effect directed sideways.

Also a spreading device including a roll row comprising mantle elements journalled at separate shafts is known by the art. The roll row forms a contact area resembling a broken line, which comprises an interruption or clearance between two mantle elements. The shaft of a single roll is supported by a support device and at support points located at the roll shaft ends. The clearance must be so small, that the moving web does not settle down in the clearance. However, the extension of said clearance along the roll row depends mainly on the dimensions of the support device of the roll shaft. The support device is usually attached to an external body. Hereby the distance between the shaft support point and the external body can be altered, whereby the average curvature of the broken line alters. In addition to the earlier described longitudinal stretching, a further problem is the difficulty to form a general shape for the broken line, which would be smooth and continuous enough at these interruption locations. Futhermore, the distance from two support points to the body must be unequally adjusted in the same direction to ensure that the shaft position corresponds to a certain curvature. Hereby the roll shaft and its support device must be trimmed in a skew orientation relative to each other. For the provision of a skew adjustment, the interruption must be allowed to be larger than in a rectangular trimming.

THE OBJECT AND THE SUMMARY OF THE INVENTION

The object of the invention is to provide an arrangement, in which the web or the web strips can be spread in the transverse direction, so that a web gliding on the spreading member in the direction of the longitudinal extension of the spreading member is avoided. A further object is a curvature profile adjustment which makes possible a governed co-operation between the web and the arrangement.

The object of the invention is achieved by an arrangement, the characteristics of which are described in claim 1. Hereby two advantages are gained by journalling a rigid roll at a bendable support member. The spreading appliance deflection which guides the web is easily adjusted towards the web. At the same time, a mainly linear line contact is maintained between the web and the roll. Hereby a web glide shift directed parallel to the roll shaft can be eliminated. A favourable curvature towards the web is possible to arrange in the support member by altering the distance between said support member and the body member at a plurality of transverse locations of the web. Thus, the spreading appliance is provided with two deflection options, which are independent from each other.

In a favourable spreading appliance, a support member is supported at a rigid, for instance beam-like, body member. The support member is more flexible than the body member. The pretrimmed curvature in the web travel direction can be arranged cross-wise relative to a second curvature arranged towards the web. This is an uncomplicated arrangement if, for instance, a beam-like body member is used. An efficient compensation of the web transverse tensions is possible by arranging at least two spreading appliances on opposite facing sides of the web. The appliances are located at a separation from each other, in the web travel direction. Hereby the adjusted appliance curvatures are mainly oppositely directed. By this means, a local web tightening is avoided, whereby the transverse tension is easily maintained at a constant level.

The web spreading process is governed by selecting distances in front and behind the spreading appliances, within which distances the travelled path of all web portions is mainly equal. Hereby, for instance, the different edges of the web strip are equally taut. A web processing device known per se can be located at a distance from the spreading appliance, corresponding to the distance between the two spreading appliances. A web slitter, for instance, can be in front of the first appliance and a roll winder or wrapper after the second appliance. An easily governed curvature adjustment is possible by adjustment members of the spreading appliance. The adjustment members can be pneumatic or mechanical devices known per se. The properties of these devices are selected so that the second curvature of the spreading appliance is affected by a mainly equimagnitude force effect arranged in the adjustment members. An uncomplicated selection of mechanical properties is possible in screw operated devices. In pressurized air bellows-spring devices for instance, an equal pneumatic pressure can be applied. An equimagnitude effect in a pneumatic adjustment member can be trimmed by a trim device governing the spring force and/or the pressure. The trimming may, for example, be achieved by prestressing the springs so that they are compressed even when the bellows are not pressurized.

The support member of the first spreading appliance can be arranged at a fixed distance from the central portion of the body member, and, at both sides hereform, at an adjustable distance. Correspondingly, the support member of the second appliance is located at a fixed distance from the heads of the body member at positions near the body member outer heads. Between these heads, the distance is adjustable. In order to assist the bending arranged in the support member, at least one trim member comprises an attachment member which allows a releasable motion of the support member in the web transverse direction.

BRIEF DESCRIPTION OF THE DRAWING

The invention is described with reference to the attached drawing, in which.

BEST MODE OF THE INVENTION

Figure 1:
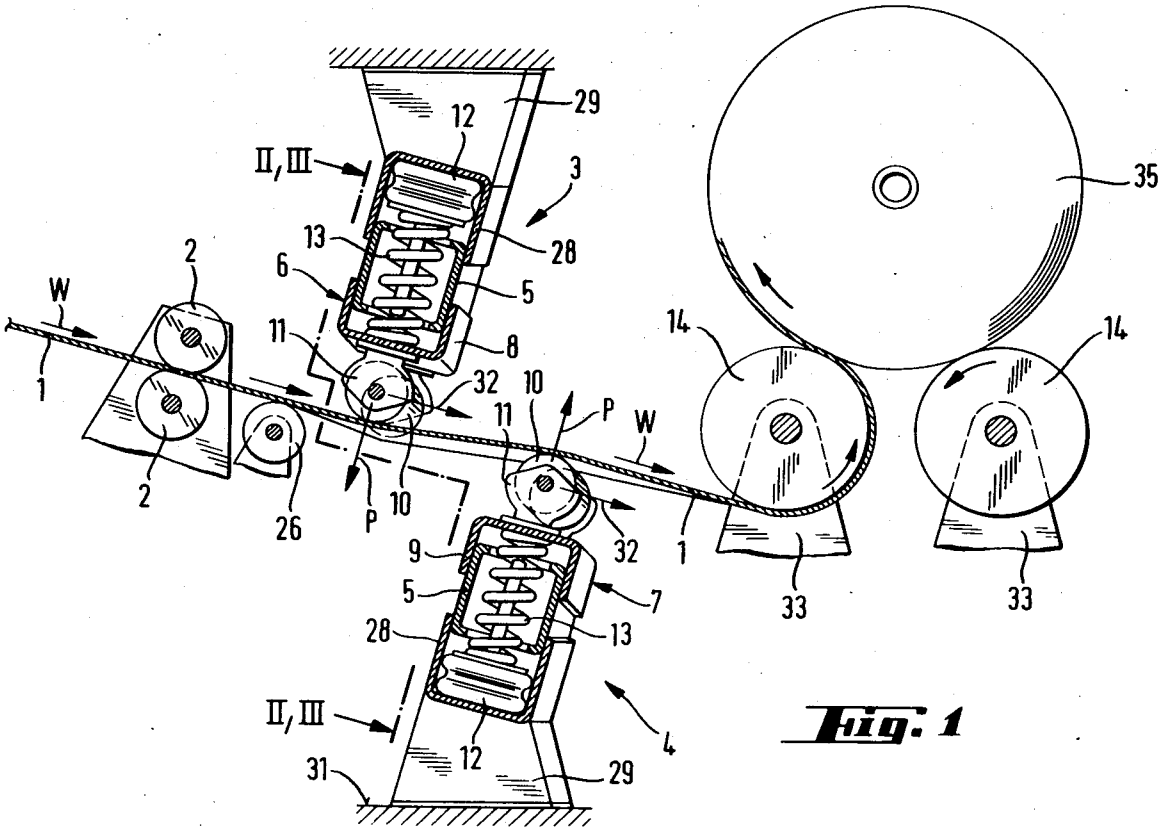
FIG. 1 shows a side view of an embodiment of the spreading appliance for web processing.

A web 1 travelling in a direction W is cut by a web slitter 2 into a plurality of parallel web strips, which are guided via an auxiliary drum 26 and spreading appliances 3, 4 to a support drum winder 14. Web strips are generally noted by the common reference numeral 1. Web 1 or web strip is wound on to a roll 35 in winder 14. Appliances 3, 4, which spread web 1 or web strips in their transverse direction, are supported by means of a beam member 28 to the body 29 of the arrangement, which is not shown in detail. In accordance with the slitter 2 operation, the following description refers to the separation of adjacent web strips and the spreading of each strip. If slitter 2 is replaced by another device, for instance by a roll press nip, the description refers to the spreading of the uniform web.

Spreading appliance 3 comprises a rigid body beam 5, and supported thereat, a spreading member 6. Spreading member 6 comprises a flexible support member 8 and a plurality of rigid rolls 10 journalled at member 8 by bearings 11. The corresponding members of appliance 4 are referred by numerals 7,9,10 and 11. Rolls 10 are positioned one after another in the transverse direction of web 1 so that the roll row is deflected in web travel direction W to a preselected curvature 32. Hereby the central portion of the roll row is nearest to support drums 14. The second curvature P towards the web is adjusted as follows. The deflection of support member 8, correspondingly support member 9, is carried out in a direction P by altering the distance between the support member and body beam 5 at several positions in the transverse direction of web 1. The distance adjustment is carried out by mechanical-pneumatical trim devices 12, 13 which comprise a spring 13 and a pneumatic bellows device 12. Trim device 12, correspondingly 13, is supported at beam member 28. The functions of bellows 12 and spring 13 are arranged mutually balancing. Hereby the bellows generate a force which shifts support member 8 relative to body beam 5 in direction P. This shift in turn generates a force effect in spring 13, which resists the shift. The separations between devices 2,3,4 and 14 are so selected, that web 1 travels along the path between devices 2,14 without being locally tightened. Reference numeral 31 refers to a floor level and 33 to a support construction of winder drums 14. The support of slitter 2 and auxiliary drum 26 is only briefly outlined.

Figure 2:
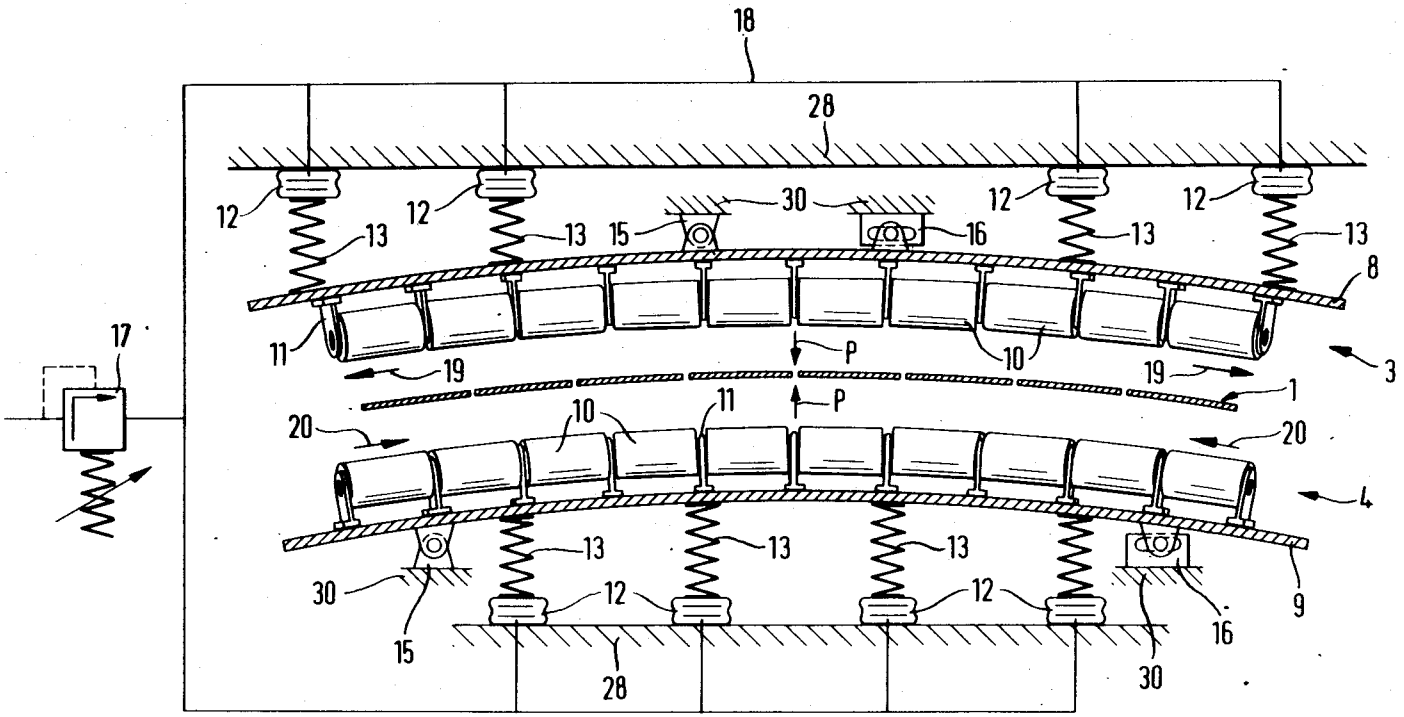
FIG. 2 shows schematically the curvature adjustment of the spreading appliance, as a front view with reference to section II—II in FIG. 1.

A schematic adjustment arrangement is shown in FIG. 2, viewed about parallel to travel direction W of web 1. For clarity reasons, web 1 is shown out of contact with appliances 3,4. Bearing 11 is located between adjacent rolls 10. Reference numeral 15 refers to a statically located support member of body member 5. A support member 16 is movably trimmable in the transverse direction of web 1. The control and supply of the pneumatic fluid of bellows 12 is arranged via control valve 17 and ducts 18. Arrows 19 show the spreading effect directed on web 1 by appliance 3 and correspondingly arrows 20 show the effect of appliance 4. The curvature of spreading appliances 3,4 towards web 1 are directed opposite, so that effects 19,20 are directed in opposite directions with respect to the web transverse direction. Reference numeral 30 refers to a back-up body element of support member 15, 16. Element 30 can be a bar, beam or arm supported at or attached to beam member 28, or preferably at body 5. Element 30 can also be a bushing or a bearing housing member, which is suitably supported at appliance 3,4.

Figure 3:
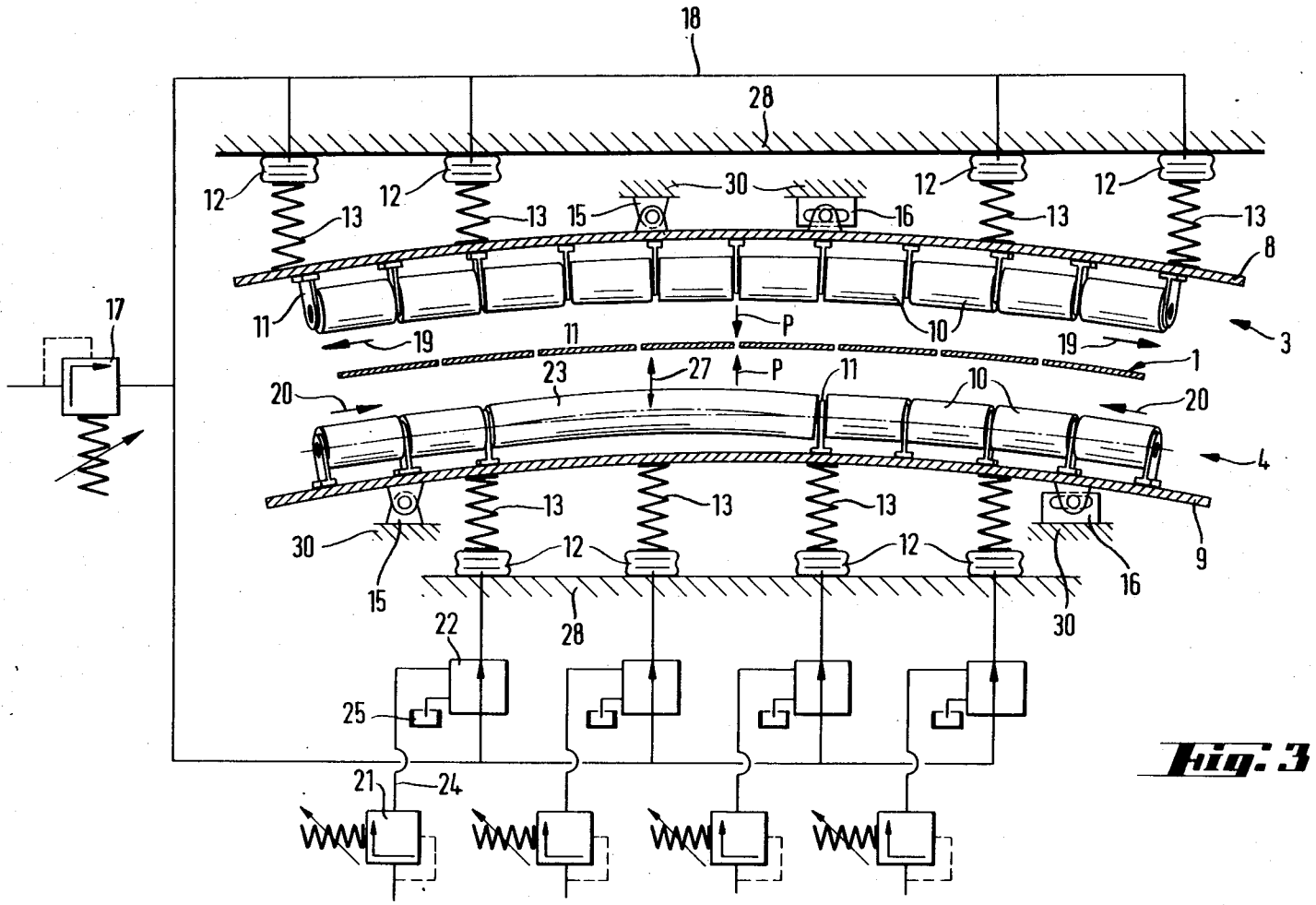
FIG. 3 shows modification of the arrangement according to FIG. 2.

FIG. 3 shows a modification, in which pneumatic control devices 22 are connected to trim devices 12,13 of one of the spreading appliances. These devices 22 are, for instance, s.c. Booster-or summarizing valves. Control device 22 is governed by a control valve 21, which is connected via ducts 24 to device 22. References numeral 25 refers to a common pneumatic safety member, for instance, a safety valve. Pressure can be increased or decreased by means of described members 21,22 in a chosen trim device 12,13, in order to provide a local adjustment of the second curvature P. By this means an possible exceptional tension in web 1, caused by a profile defect, can be eliminated. Reference numeral 23 in FIG. 3 refers to a roll among rolls of appliance 4, in which the local adjustment of the second curvature is carried out. the effect generated by the local adjustment is exaggerated in FIG. 3 for clarity reasons. The linear shift 27 is usually less than 1 millimeter, 5 millimeters at the most. Roll 23 is in the axial direction longer than roll 10. Through curvature being adjustable by bending support member 9, one can instead of roll 23 also apply a plurality of rolls corresponding axial extension of roll 23, as well.

As understood from the description, the clearance between two adjacent rolls 10, or roll 10 and roll 23, remains mainly uneffected although the curvature P of the roll row is considerably varied. This is a result of the co-directed shifts of said adjacent rolls and bearing 11 therebetween.

Figure 4:
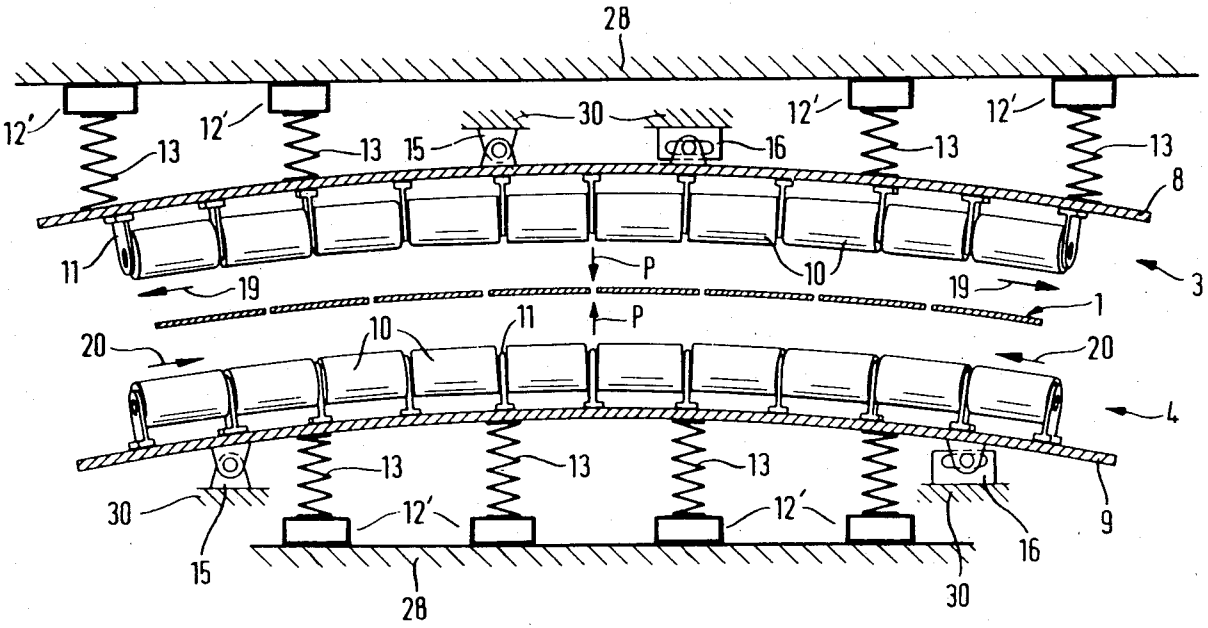
FIG. 4 is a view similar to FIG. 2 showing another embodiment of the invention.

FIG. 4 shows an embodiment of the invention in which the pneumatic bellows devices 12 of the appliances 3 and 4 are replaced by screw-operated devices 12'.

The invention is not limited to the embodiments shown, but several modifications thereof are feasible within the scope of the invention. Travel direction W of web 1, for instance, can be altered at spreading appliance 3,4. Hereby the web might contact the mantle of roll 10 along a path, which corresponds to a central angle 20° . . . 60°.

I claim:

1. An apparatus for transverse spreading of a travelling web, in particular a web of paper or like material, comprising a body member, a spreading device, and means supporting the spreading device from the body member so that the spreading device extends over substantially the entire transverse dimension of the web, said spreading device comprising a support member which can be bent towards the web, and at least two essentially rigid rolls each having two ends, a central axis, and a curved exterior surface at a predetermined radial distance from said central axis, and the apparatus also comprising means mounting the rolls to the support member so that, at the ends of each roll, the central axis of the roll is at a substantially constant distance, greater than said predetermined radial distance, from the support member and so that the rolls engage the web and extend one after another in the transverse direction of the web with the ends of the rolls lying on a path which is curved in the direction of travel of the web, and the means supporting the spreading device comprising a plurality of adjustment devices spaced apart in the transverse direction of the web, whereby the distance between the support member and the body member can be altered at a plurality of positions spaced apart in said transverse direction and the support member can be curved in a direction towards the web, said adjustment devices each comprising a first adjustment member that engages the body member and a second adjustment member that is effective between the first adjustment member and the support member, one of the adjustment members being an adjustable extension member and the other adjustment member being a resiliently-compressible member that resists movement of the support member towards the body member.

2. Apparatus according to claim 1, wherein said body member is essentially rigid and said support member is more flexible than said body member.

3. Apparatus according to claim 2, wherein said body member is a beam-like member.

4. Apparatus according to claim 1, in which the adjustment devices are arranged to exert forces against the support member which are generally parallel to each other.

5. Apparatus according to claim 4, in which the forces exerted by the adjustment devices are all of substantially equal magnitude.

6. Apparatus according to claim 1, wherein at least one of the rolls has a deflectable mantle, whereby the roll may be curved in said direction towards the web.

7. Apparatus according to claim 6, wherein the mantle of said one roll is deflectable by 5 mm at most, preferably less than 1 mm.

8. An apparatus for transverse spreading of a web, in particular a web of paper or like material, travelling along a predetermined path of movement, comprising first and second body members, first and second spreading devices, and means supporting the first and second spreading devices from the first and second body members respectively so that the spreading devices each extend over substantially the entire transverse dimension of the web and the first and second spreading devices are disposed at opposite respective sides of said path of movement with the first spreading device upstream of the second spreading device with respect to the direction of movement of the web, and wherein each spreading device comprises a support member which can be bent towards said path, and at least two essentially rigid rolls each having two ends, a central axis, and a curved exterior surface at a predetermined radial distance from said central axis, and each spreading device also comprising means mounting the rolls to the support member so that, at the ends of each roll, the central axis of the roll is at a substantially constant distance, greater than said predetermined radial distance, from the support member and so that the rolls engage the web and extend one after another in the transverse direction of the web with the ends of the rolls lying on a path which is curved in the direction of travel of the web, and the means supporting each spreading device comprising a plurality of adjustment devices spaced apart in the transverse direction of the web, whereby the distance between each body member and the support member of the respective spreading device can be altered at a plurality of positions spaced apart in said transverse direction and the support members of the first and second spreading device can each be curved in a direction towards the web, and wherein one support member is convex towards said path of movement and the other support member is concave towards said path of movement, each adjustment device comprising a first adjustment member that engages the respective body member and a second adjustment member that is effective between the first adjustment member and the respective support member, one of the adjustment members being an adjustable extension member and the other adjustment member being a resiliently-compressible member that resists movement of the support member towards the body member.

9. Apparatus according to claim 8, first attachment means effective to maintain opposite end portions of the support member of the first spreading device at a substantially constant distance from the first body member, and second attachment means effective to maintain a central portion of the support member of the second spreading device at a substantially constant distance from the second body member, and wherein said adjustment devices permit alteration of the distance between a central portion of the support member of the first spreading device and the first body member and between opposite end portions of the support member of the second spreading device and the second body member, and wherein the attachment means permit movement of the support member in said transverse direction.

10. Apparatus according to claim 8, further comprising a web slitter disposed upstream of the spreading devices for slitting the web into at least two portions, and a web processing device disposed downstream of said spreading devices for receiving the web portions, the distances travelled by all portions of the web from the web slitter to the web processing device being substantially equal.

11. Apparatus according to claim 8, wherein the support members of the first and second spreading device can each be curved in a direction that is substantially perpendicular to the direction of travel of the web.

12. Apparatus according to claim 1, wherein the support member can be curved in a direction that is substantially perpendicular to the direction of travel of the web.

13. Apparatus according to claim 1, wherein each adjustable extension member comprises a fluid-operated expansion member.

14. Apparatus according to claim 13, wherein each fluid-operated expansion member is a pneumatic bellows device.

15. Apparatus according to claim 14, wherein the bellows devices are connected together to receive the same pnuematic pressure.

16. Apparatus according to claim 13, wherein each resiliently-compressible member comprises a compression spring, and the fluid-operated expansion members are connected together to receive the same fluid pressure.

17. Apparatus according to claim 13, wherein each resiliently-compressible member comprises a compression spring, and each adjustment device comprises means for adjusting at least one of the spring force and the fluid pressure connected to the expansion member in order that the forces exerted by the several adjustment devices should be of substantially equal magnitude.

18. Apparatus according to claim 1, wherein each adjustable extension member is a screw-operated member.

* * * * *